US011622612B2

(12) United States Patent
Cabon

(10) Patent No.: US 11,622,612 B2
(45) Date of Patent: Apr. 11, 2023

(54) APPLICATOR BRUSH

(71) Applicant: L'OREAL, Paris (FR)

(72) Inventor: Chloe Cabon, Clichy (FR)

(73) Assignee: L'OREAL, Paris (FR)

( * ) Notice: Subject to any disclaimer, the term of this patent is extended or adjusted under 35 U.S.C. 154(b) by 379 days.

(21) Appl. No.: 16/626,773

(22) PCT Filed: Jun. 20, 2018

(86) PCT No.: PCT/EP2018/066455
§ 371 (c)(1),
(2) Date: Dec. 26, 2019

(87) PCT Pub. No.: WO2019/002054
PCT Pub. Date: Jan. 3, 2019

(65) Prior Publication Data

US 2020/0154848 A1 May 21, 2020

(30) Foreign Application Priority Data

Jun. 29, 2017 (FR) ..... 1756011

(51) Int. Cl.
*A45D 33/00* (2006.01)
*A46B 5/02* (2006.01)
(Continued)

(52) U.S. Cl.
CPC ..... *A45D 33/006* (2013.01); *A46B 5/02* (2013.01); *A46B 9/021* (2013.01); *A46B 9/025* (2013.01);
(Continued)

(58) Field of Classification Search
CPC .. A45D 33/006; A45D 34/042; A45D 34/045; A45D 40/265; A45D 40/262;
(Continued)

(56) References Cited

U.S. PATENT DOCUMENTS 9,808,076 B1 * 11/2017 DeVito ..... A46B 7/023
2005/0138746 A1 6/2005 Young-Chul
(Continued)

FOREIGN PATENT DOCUMENTS

EP 1 342 428 A1 9/2003
FR 2 903 585 A1 1/2008
(Continued)

OTHER PUBLICATIONS

International Search Report dated Aug. 7, 2018 in PCT/EP2018/066455 filed on Jun. 20, 2018.
(Continued)

*Primary Examiner* — Nicholas D Lucchesi
(74) *Attorney, Agent, or Firm* — Oblon, McClelland, Maier & Neustadt, L.L.P.

(57) ABSTRACT

The present invention relates to an applicator brush (1) for applying a cosmetic, make-up or care product to human keratin materials, especially the eyebrows, comprising a handle (4) which extends along a longitudinal axis (X) and, at the distal end thereof, an applicator head (2) having distal (2*c*) and proximal ends, and carrying a tuft (3) of bristles (6), the free ends (6*a*) of which define an applicator surface (5) that is convex towards the outside, in which applicator the applicator head (2) extends along a longitudinal axis (Y) that is not parallel to the longitudinal axis (X) of the handle (4), and wherein the tuft (3) of bristles (6) is arranged such that the transverse dimension of the applicator surface (5) increases towards the distal end (2*c*) of the applicator head (2), passing through a maximum, before decreasing from the location at which the transverse dimension is maximum towards the distal end (2*c*), the maximum of the transverse dimension of the applicator surface (5) being closer to the proximal end of the applicator head (2) than to the distal end (2*c*) thereof.

14 Claims, 3 Drawing Sheets

Figure 1:
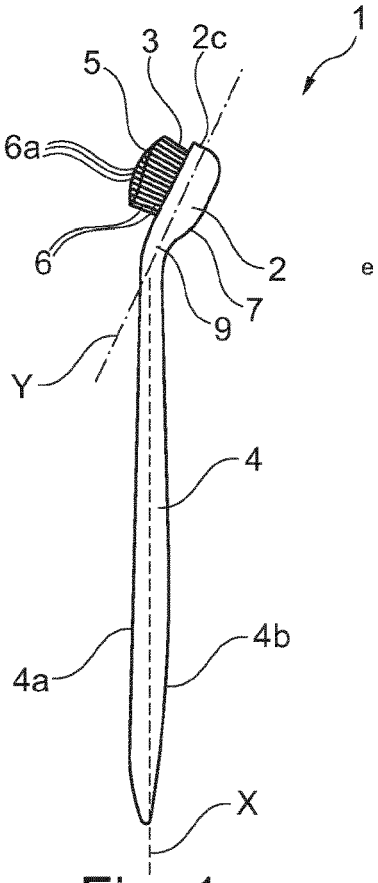

(51) Int. Cl.
*A46B 9/02* (2006.01)
*A46D 1/04* (2006.01)

(52) U.S. Cl.
CPC ..... *A46B 2200/1046* (2013.01); *A46D 1/04* (2013.01)

(58) Field of Classification Search
CPC ..... A46B 5/02; A46B 9/021; A46B 9/025; A46B 9/02; A46B 9/026; A46B 9/028
See application file for complete search history.

(56) References Cited

U.S. PATENT DOCUMENTS

| | | | | |
|---|---|---|---|---|
| 2008/0011317 | A1 | 1/2008 | Malvar et al. | |
| 2008/0283083 | A1* | 11/2008 | Piao | A46B 15/0091 132/313 |
| 2010/0132731 | A1* | 6/2010 | Waitesmith | A46B 5/021 15/171 |
| 2010/0303533 | A1 | 12/2010 | Gueret | |
| 2014/0360521 | A1 | 12/2014 | Caulier et al. | |
| 2016/0081456 | A1* | 3/2016 | Grund | A46B 9/021 132/320 |
| 2016/0113375 | A1* | 4/2016 | Lim | A45D 33/36 401/118 |
| 2016/0128445 | A1* | 5/2016 | Lim | A45D 34/042 132/317 |
| 2016/0262528 | A1* | 9/2016 | Telwar | A46B 9/021 |
| 2016/0324306 | A1* | 11/2016 | Martin | A45D 34/042 |
| 2017/0265626 | A1* | 9/2017 | Earl | A45D 40/04 |
| 2018/0055195 | A1* | 3/2018 | Querna | A46B 9/021 |

FOREIGN PATENT DOCUMENTS

| | | | |
|---|---|---|---|
| FR | 2 922 421 | A1 | 4/2009 |
| FR | 2 979 525 | A1 | 3/2013 |
| FR | 2 983 048 | A1 | 5/2013 |
| JP | 2013-102926 | A | 5/2013 |
| WO | WO 2010/065188 | A2 | 6/2010 |

OTHER PUBLICATIONS

French Preliminary Search Report dated Feb. 1, 2018 in FR 1 756 011 filed on Jun. 29, 2017 citing documents AA-AC and AO-AS therein, 2 pages.

* cited by examiner

APPLICATOR BRUSH

The present invention relates to cosmetic applicator brushes and more particularly, but not exclusively, to those intended for applying a product to the eyebrows.

The brushes generally used for applying a product to the eyebrows are thin, bevelled brushes, limiting product loading and reducing the application zone.

Application WO 2010/065188 discloses an applicator brush for the face, comprising a bent handle with an applicator head extending non-parallel to the handle.

Application JP 2013-102926 describes a brush for applying a nail varnish, comprising a tuft of bristles having a drop-shaped cross section.

Application US 2005/138746 relates to a brush comprising a tuft of bristles defining an applicator surface that is domed towards the outside.

There is a need to facilitate the application of a product with an applicator brush, in particular to the eyebrows, by enabling especially a precise application using the correct amount of product.

The invention aims to meet this need, and achieves this, according to one of its aspects, by virtue of an applicator brush for applying a cosmetic, make-up or care product to human keratin materials, especially the eyebrows, comprising a handle which extends along a longitudinal axis and, at the distal end thereof, an applicator head having distal and proximal ends, and carrying a tuft of bristles, the free ends of which define an applicator surface that is convex towards the outside, in which applicator the applicator head extends along a longitudinal axis that is not parallel to the longitudinal axis of the handle, and wherein the tuft of bristles is arranged such that the transverse dimension of the applicator surface increases towards the distal end of the applicator head, passing through a maximum, before decreasing from the location at which the transverse dimension is maximum towards the distal end, the maximum of the transverse dimension of the applicator surface being closer to the proximal end of the applicator head than to the distal end thereof.

The applicator surface is preferably convex about an axis perpendicular to the longitudinal axis of the applicator head. The applicator surface is preferably also convex about the longitudinal axis of the applicator head. The applicator surface is thus advantageously domed both along the longitudinal direction and along the transverse direction of the brush, which makes it possible to more readily adjust the extent of the applicator surface which is in contact with the keratin materials by altering, especially, the pressure applied to the tuft of bristles. This makes it possible to control the application more precisely and contributes to regular application of the product.

The variation in the width of the tuft of bristles makes it possible to obtain, on the applicator surface, both a relatively wide zone and a zone that is tapered towards the distal end of the applicator. This enables satisfactory loading with product while retaining precise application, for example for applying the product at the outer tip of the eyebrow line.

The inclination of the applicator head relative to the handle contributes to ergonomics, and enables the user to easily and precisely reach the whole eyebrow.

The applicator head forms a bend with the handle and is thus off-centre. "Off-centre" should be understood to mean that the distal end of the applicator head is not on the longitudinal axis of the handle.

Applicator Surface and Head

The tuft of bristles is preferably arranged on the opposite side to the depression of the bend formed by the applicator head and the handle when the brush is viewed from the side.

The axis along which the applicator head extends may form, with the longitudinal axis of the handle, an angle $\alpha$ of between 15° and 45°, better still between 25° and 35°.

The distance between the point of the applicator head that is the furthest from the longitudinal axis of the handle and the edge of the handle opposite the head, measured perpendicularly to the longitudinal axis of the handle, may be between 9 mm and 20 mm.

The largest transverse dimension of the applicator surface may be between 2.5 mm and 6 mm. The transverse dimension of the applicator surface is measured between two opposite points of the applicator surface having the same axial position along the applicator head, in a plane perpendicular to the longitudinal axis of the applicator head. The length of the applicator surface, measured along the longitudinal axis of the applicator head, may be between 7 mm and 12 mm.

The shape of the applicator head may substantially follow that of the tuft of bristles. Thus, the transverse dimension of the applicator head may decrease towards the distal end of the applicator head. Preferably, the transverse dimension of the applicator head increases towards the distal end thereof, passing through a maximum, before decreasing from the location at which the transverse dimension is maximum towards the distal end. The applicator surface and the applicator head may thus have a generally oval, droplet shape.

The largest transverse dimension of the applicator head may be between 2 mm and 7 mm. The transverse dimension of the applicator head is measured between two opposite points of the applicator head having the same axial position along the applicator head, in a plane perpendicular to the longitudinal axis of the applicator head.

The length of the applicator head, measured along the longitudinal axis of the applicator head, may be between 5 mm and 14 mm.

The tuft of bristles of the applicator brush according to the invention may comprise bristles of different lengths arranged such that the applicator surface is convex towards the outside. In this case, the difference in the length of the bristles between a bristle of minimum length and a bristle of maximum length, measured perpendicularly to the axis of the bristles, may be between 0.2 mm and 8 mm.

A housing is advantageously arranged in the applicator head in order to receive the tuft of bristles. This housing may have a flat bottom, in particular in the case in which the tuft of bristles comprises bristles of different lengths.

In a variant, the housing is of variable depth, the bristles being implanted in the housing such that the applicator surface is convex towards the outside. In this case, the bottom of the housing may have a rounded shape, especially convex towards the outside. The bristles may be of the same length.

The applicator surface may be symmetrical relative to a median plane extending along the longitudinal axis of the applicator head.

The applicator surface may have a spherical cap shape, or a conical, aspherical or prismatic shape.

The applicator head advantageously only carries bristles on one side.

The applicator head may be solid, that is to say it does not have cut-outs.

The applicator head is different from a twisted metal core, from a moulded core having attached bristles and from bristles moulded in one piece with a core.

Handle

The longitudinal axis along which the handle extends is preferably rectilinear over the whole length of the handle.

The handle may have a flat portion on the applicator surface side, in order to facilitate holding the brush in the hand during application of the product.

The handle may thus have a planar surface on the applicator surface side, and a surface domed towards the outside on the opposite side to the applicator surface.

The thickness of the handle may taper in the direction of the part thereof which is connected to the applicator head.

The transverse dimension of the handle may decrease in the direction of the part thereof which is connected to the applicator head, the ratio between the minimum and the maximum of the transverse dimension of the handle being preferably between 0.3 and 0.8.

The handle may be made from a thermoplastic material such as PCTA, PA, PP or PET, from wood, metal, ceramic or from glass.

The applicator brush may be symmetrical relative to a median plane, preferably relative to a median plane parallel to the longitudinal axis of the brush.

Bristles

The longitudinal axis of each bristle may be oriented substantially perpendicular to the longitudinal axis of the applicator head, at the base thereof, where it connects to the applicator head.

The bristles may be attached by any means to the applicator head. The bristles may be implanted in the applicator head after its manufacture, or, as a variant, the applicator head is overmoulded onto the bristles.

The bristles may be attached by one or more staples in a housing arranged in the applicator head. The bristles may be formed from a tuft folded on itself around the staple. The bristles may further be held by adhesive bonding only in the corresponding housing of the applicator head. In a variant, the bristles are held by clamping in the housing.

The bristles may be accommodated in bundles in corresponding housings formed in the applicator head.

The bristles may have, in cross section, a largest dimension of between 3/100 mm and 10/100 mm.

The maximum visible length of the bristles may be between 4 and 50 mm.

The thickness of the part of the applicator head carrying the bristles may be substantially equal to the visible length of the bristles.

Application Assembly

A further subject of the invention is an assembly for applying a cosmetic product, comprising an applicator brush according to the invention, as defined above, and a container containing the product to be applied, selected especially from a care product for the eyebrows, or a make-up product to be applied to the eyebrows, being especially in the form of a powder, a gel or a wax.

The container is preferably a powder compact with a cover. The container may contain one or more products to be applied.

Make-Up Process

A further subject of the invention is a process for making up the eyebrows, using an assembly for applying a product according to the invention, wherein the product is taken up from the container by means of the applicator brush as defined above, and wherein the product is applied to the eyebrows by means of the applicator brush.

In particular, application to the outer tip of the eyebrow line may be carried out with the distal part of the applicator surface, where its transverse dimension is smaller, in order to have a precise application.

The features mentioned above for the brush apply to the assembly and to the make-up process.

DETAILED DESCRIPTION

Figure 2:
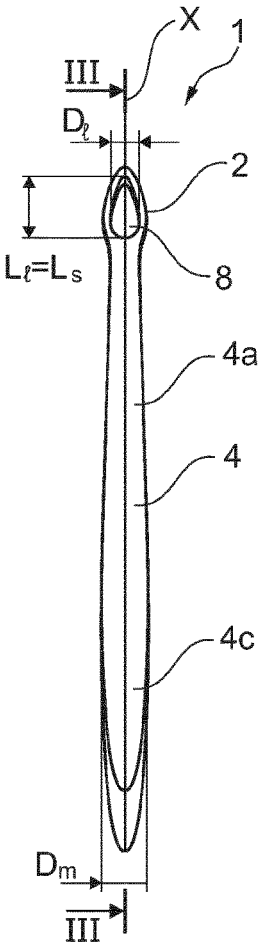
Figure 3:
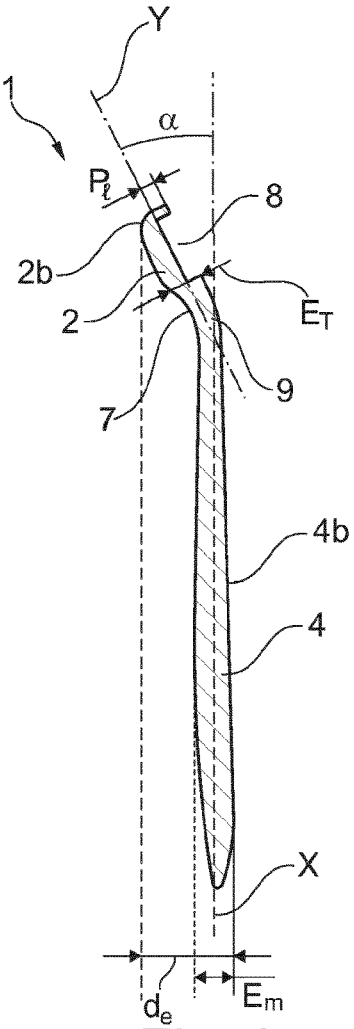
Figure 3A:
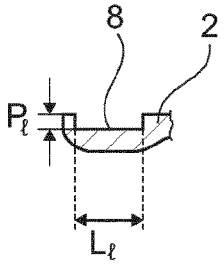
Figure 4:
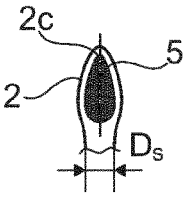
Figure 5:
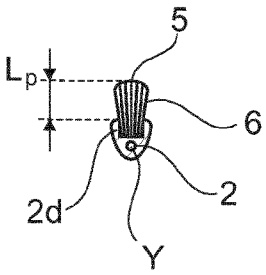
Figure 6:
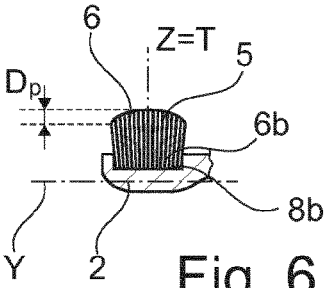
Figure 7:
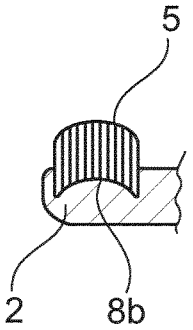
Figure 8:
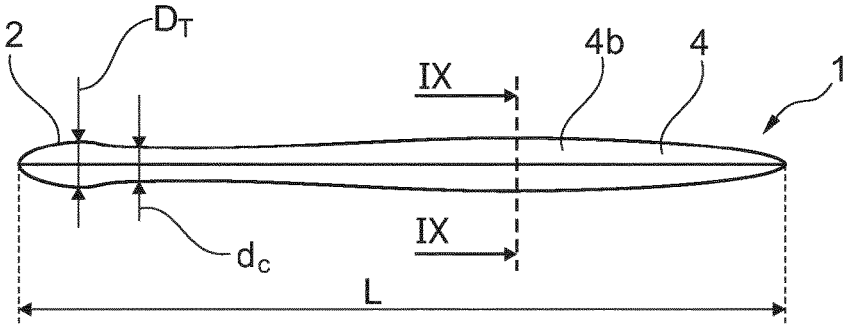
Figure 9:
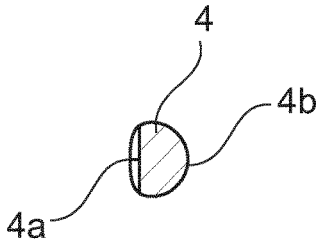
Figure 18:
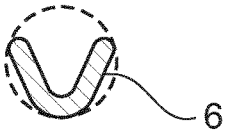
Figure 19:
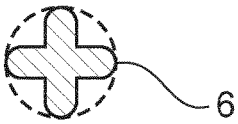
Figure 20:
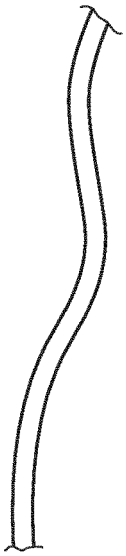
Figure 21:
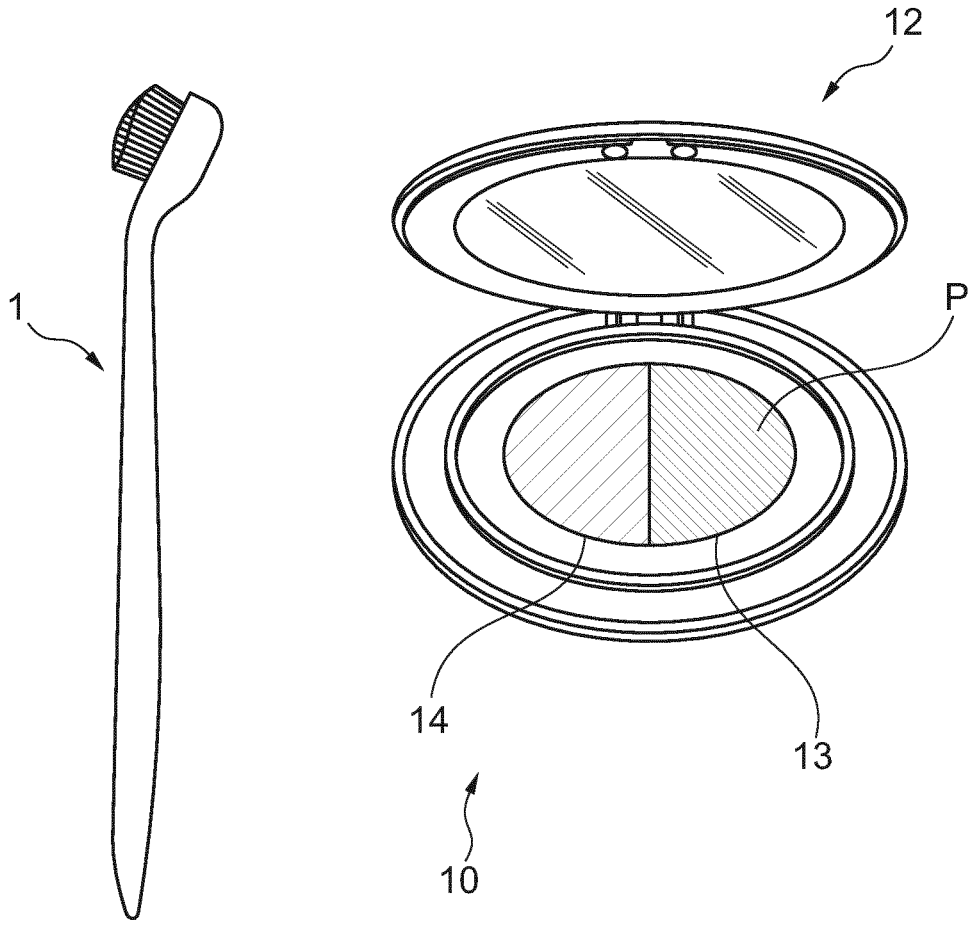

The invention may be understood better from reading the following detailed description of nonlimiting exemplary embodiments thereof and from studying the appended drawing, in which:

FIG. 1 shows an applicator brush according to the invention,

FIG. 2 is a top view of the applicator brush from FIG. 1, without the tuft of bristles, FIG. 3 is a partial and schematic longitudinal section, along III-III, of the applicator brush from FIG. 2, FIG. 3A shows the applicator head of the applicator brush from FIG. 3, on its own, FIG. 4 is a partial top view of the brush according to the invention, illustrating an exemplary embodiment of the tuft of bristles, FIG. 5 shows a schematic and partial cross section of the tuft of bristles of the applicator brush from FIG. 1, FIG. 6 shows a schematic and partial longitudinal section of the tuft of bristles of the applicator brush from FIG. 1, FIG. 7 shows a schematic and partial longitudinal section of a variant of the tuft of bristles for the applicator brush according to the invention, FIG. 8 is a bottom view of the applicator brush from FIG. 1, FIG. 9 is a partial and schematic cross section, along IX-IX, of the applicator brush from FIG. 8, FIGS. 10 to 19 schematically show examples of cross sections of bristles in accordance with the invention, FIG. 20 schematically shows an elevation view of an example of a wavy bristle, and FIG. 21 shows an example of an assembly for applying a cosmetic product, comprising an applicator brush according to the invention.

FIGS. 1 to 3 show an applicator brush 1 comprising a handle 4 extending along a longitudinal axis X, rectilinear over the whole length of the handle, and an applicator head 2 carrying a tuft 3 of bristles 6, the free ends 6*a* of which define an applicator surface 5 for the application of a cosmetic or care product P.

In this example, the applicator head 2 extends along a longitudinal axis Y that is not parallel to the longitudinal axis X of the handle 4, forming, with the latter, an angle $\alpha$ of between 15° and 45°, equal to 26° in the example in question, as shown in FIG. 3.

Preferably, and as shown, the tuft 3 of bristles 6 is arranged on the opposite side to the depression 7 of the bend formed by the applicator head 2 and the handle 4 when the brush 1 is viewed from the side.

The distance $d_e$ between the point 2*b* of the applicator head 2 that is the furthest from the longitudinal axis X of the handle 4 and the edge 4*b* of the handle 4 opposite the applicator head 2, measured perpendicularly to the longitudinal axis X of the handle 4, may be between 9 mm and 20 mm, being equal to 13 mm in the example in question. The applicator head 2 advantageously comprises a housing 8 intended to accommodate the bristles 6, which can be seen in FIGS. 2, 3 and 3A. The bristles 6 are, in the described example, held by adhesive bonding only in this housing 8.

The depth $P_1$ of the housing 8 may be between 1.5 mm and 5 mm, being equal to approximately 2.3 mm in the example in question. The length $L_1$ of the housing 8, corresponding substantially to the length $L_s$ of the applicator surface 5, may be between 7 mm and 12 mm, being equal to approximately 9 mm in the example in question.

The largest transverse dimension $D_1$ of the housing 8 may be between 2.5 mm and 6 mm, being equal to approximately 4 mm in the example in question.

The thickness $E_T$ of the applicator head 2 may be between 4 mm and 8 mm, being equal to approximately 5.5 mm in the example in question.

As can be seen in FIG. 4, the tuft 3 of bristles 6 is arranged such that the transverse dimension of the applicator surface 5 increases towards the distal end 2*c* of the applicator head 2, passing through a maximum $D_s$, before decreasing from the location at which the transverse dimension is maximum towards the distal end 2*c*. In the example in question, the maximum $D_s$ of the transverse dimension of the applicator surface 5 is closer to the proximal end 2*a* of the applicator head 2 than to the distal end 2*c* thereof, being located substantially halfway along the first half of the applicator surface 5, starting from the part 9 which connects the applicator head 2 to the handle 4.

The largest transverse dimension $D_s$ of the applicator surface 5 may be between 2.5 mm and 6 mm, being equal to approximately 4 mm.

The transverse dimensions of the housing 8 and of the applicator head 2 advantageously follow the change in the transverse dimension of the applicator surface 5. As can be seen in FIGS. 2 and 8, the transverse dimension of the applicator head 2 increases towards the distal end thereof 2*c*, passing through a maximum $D_T$, before decreasing from the location at which the transverse dimension is maximum towards the distal end 2*c*. The transverse dimension of the housing 8 is substantially equal to the transverse dimension of the applicator surface 5 at each axial position along the longitudinal axis of the applicator head 2.

The largest transverse dimension $D_T$ of the applicator head 2 may be between 4 mm and 8 mm, being equal to approximately 6 mm.

As can be seen especially in FIGS. 5 and 6, the applicator surface is convex toward the outside, both about an axis T perpendicular to the longitudinal axis Y of the applicator head 2 and about this longitudinal axis Y. To this end, as in the example from FIGS. 3 and 6, the tuft of bristles 3 comprises bristles 6 of different visible lengths, arranged such that the applicator surface 5 is convex toward the outside. In particular, the bristles 6 located in the central zone of the applicator surface 5 are longer than those located in the edge zones. In this case, the bottom 8*b* of the housing 8 is flat. The difference $\Delta_p$ in length of the bristles 6 is for example between 0.2 mm and 8 mm.

In the variant from FIG. 7, the housing 8 of the applicator head 2 receiving the bristles 6 has a variable depth, the bristles 6 being implanted in the housing such that the applicator surface is convex towards the outside. In this example, the bottom 8*b* of the housing 8 is of rounded shape, convex towards the outside, and the bristles 6 are all the same length.

As can be seen in FIGS. 1 and 9, the handle 4 has a planar surface on the side 4*a* of the applicator surface 5, and a surface domed towards the outside on the side 4*b* opposite to the applicator surface 5.

In the example in question, the handle 4 has a flat portion 4*c* on the side 4*a* of the applicator surface 5, which can be seen in FIG. 2.

Preferably, and as shown in FIGS. 1 and 3, the thickness of the handle 4 tapers in the direction of the part 9 thereof which is connected to the applicator head 2.

The largest thickness $E_m$ of the handle 4 may be between 4 mm and 8 mm, being equal to approximately 5 mm in the example in question.

The transverse dimension of the handle 4 may decrease in the direction of the part 9 thereof which is connected to the applicator head 2, as illustrated.

The transverse dimension $d_c$ of the handle 4 at the part 9 thereof which is connected to the applicator head 2 may be between 3.5 mm and 6.5 mm, being equal to approximately 4 mm in the example in question. The largest transverse dimension $D_m$ of the handle 4 may be between 5.5 mm and 20 mm, being equal to approximately 7 mm in the example illustrated.

The total length L of the brush 1 may be between 50 mm and 150 mm, being equal to approximately 97 mm in the example in question.

The maximum visible length $L_p$ of the bristles 6, extending beyond the part 2*d* of the applicator head 2 carrying the bristles, is for example between 4 and 50 mm, being equal to approximately 5.7 mm in the example in question.

The longitudinal axis Z of each bristle 6 is oriented substantially perpendicular to the longitudinal axis Y of the applicator head 2, at the base 6*b* thereof, where it connects to the bottom 8*b* of the housing 8, as can be seen in FIG. 7.

The section of at least one bristle 6 is substantially constant over the whole visible length of the bristle, but various bristles may be used, as described in detail below.

The bristles 6 have for example in cross section a largest dimension of between 3/100 mm and 10/100 mm, for example of 7/100 mm approximately.

The bristles 6 may be of a wide variety of natures, and bristles may especially be used that have one of the cross sections illustrated in FIGS. 10 to 19.

Figure 10:
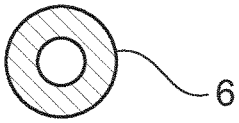
Figure 11:
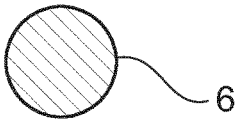
Figure 12:
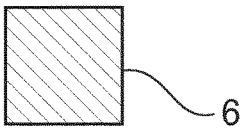
Figure 13:
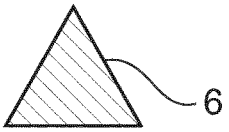
Figure 14:
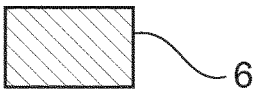
Figure 15:
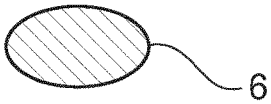
Figure 16:
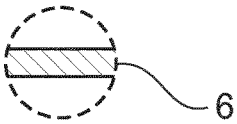

This may be for example a hollow cross section with a circular contour as illustrated in FIG. 10, a solid cross section with a circular contour as illustrated in FIG. 11, a polygonal cross section as illustrated in FIGS. 12 to 14, for example square, triangular or rectangular, or else an oblong cross section, for example with an elliptical or oval contour as illustrated in FIG. 15, or else flattened, as illustrated in FIG. 16.

Figure 17:
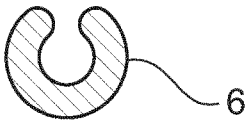

As a variant, the bristles 6 may comprise at least one capillary groove, as illustrated in FIGS. 17 to 19, the bristles having for example a cross section of generally circular shape as illustrated in FIG. 17 or in a V shape as illustrated in FIG. 18, or cruciform as illustrated in FIG. 19.

The applicator brush 3 according to the invention may comprise solely identical bristles, or as a variant a mixture of bristles having different shapes, sections and/or dimensions, especially a diameter, and/or materials.

At least one bristle may be wavy, as illustrated in FIG. 20. Wavy bristles make it possible to better retain the product and are particularly suited to the application of powders.

At least one bristle may be manufactured by material extrusion.

The bristles 6 may be constituted of natural fibers.

In a variant, the bristles 6 may be constituted of at least one synthetic material, for example chosen from the following list: PA 6,12, polyester, Rilsan®, polyamide, polyether, polyamide block-ether, polyethylene, polytetrafluoroethylene, polyvinylidene fluoride, polyacetate, polyethylene terephthalate.

Additives modifying the surface finish and the surface tension may be incorporated into the material of the bristles, for example lubricants, for example molybdenum disulfide, PTFE, graphite.

An assembly 10 for applying a product P according to the invention is shown in FIG. 21. Such an assembly 10 comprises an applicator brush 1 as described above and a container 12 containing the product P to be applied. In the example described, the container 12 is a powder compact with a cover, having two housings 13, 14 containing the product P in powder form. Each housing 13 and 14 may contain a different product, for example a make-up product in different shades, or different textures of products to be combined together, for example a powder and a wax.

The user may take up the product P from the container 12 by virtue of the brush 1 and apply it to their eyebrows, especially with the aim of re-drawing the eyebrow line or of filling out a faint line. The user may use the zone of the applicator surface 5 at which its transverse dimension is maximum in order to apply the product P to the eyebrow line on the side of the bridge of the nose, and the distal part of the applicator surface at which its transverse direction is smaller for application to the outer tip of the eyebrow line, which is generally tapered at this location.

By virtue of the invention, the product may be spread under the correct conditions to create the desired make-up effects, the widest zone of the applicator surface forming a reserve of product and the tapered zone enabling application with the required precision.

The invention is not limited to the exemplary embodiments which have just been described, and it is possible especially to combine the features of the different embodiments with one another.

For example, the handle 4 and the applicator head 2 may have other shapes than those shown.

The applicator brush according to the invention may also be used for applying a product to the skin, the hair, the eyelashes, the nails, the eyelids or the lips, the product being for example a foundation or a blusher, a hair product, especially for dyeing highlights, an eyeshadow or a lipstick.

The invention claimed is:

1. An applicator brush for applying a cosmetic, make-up or care product to the eyebrows, comprising a handle which extends along a longitudinal axis and, at a distal end thereof, an applicator head having distal and proximal ends, and carrying a tuft of bristles, free ends of which define an applicator surface that is convex towards an outside, in which applicator the applicator head extends along a longitudinal axis that is not parallel to the longitudinal axis of the handle, wherein the tuft of bristles is arranged such that a transverse dimension of the applicator surface increases towards the distal end of the applicator head, passing through a maximum, before decreasing from a location at which the transverse dimension is maximum towards the distal end, the maximum of the transverse dimension of the applicator surface being closer to the proximal end of the applicator head than to the distal end thereof, wherein a ratio between a largest transverse dimension of the applicator head and a length of the applicator head is between 0.4 and 0.5, and wherein the maximum of the transverse dimension of the applicator surface is located halfway along a first half of the applicator surface, starting from a part which connects the applicator head to the handle.

2. The applicator brush as claimed in claim 1, wherein the tuft of bristles is arranged on an opposite side to a depression of a bend formed by the applicator head and the handle when the brush is viewed from the side.

3. The applicator brush as claimed in claim 1, wherein the axis along which the applicator head extends forms, with the longitudinal axis of the handle, an angle of between 15° and 45°.

4. The brush as claimed in claim 1, wherein the transverse dimension of the applicator head increases towards the distal end thereof, passing through a maximum, before decreasing from the location at which the transverse dimension is maximum towards the distal end.

5. The brush as claimed claim 1, wherein the tuft of bristles comprises bristles of different lengths arranged such that the applicator surface is convex towards the outside.

6. The applicator brush as claimed in claim 1, wherein the applicator surface is convex about an axis perpendicular to the longitudinal axis of the applicator head.

7. The applicator brush as claimed in claim 1, wherein the applicator surface is convex about the longitudinal axis of the applicator head.

8. The applicator brush as claimed in claim 1, wherein the largest transverse dimension of the applicator surface is between 2.5 mm and 6 mm, and the length thereof, measured along the longitudinal axis of the applicator head, is between 7 mm and 12 mm.

9. The brush as claimed in claim 1, wherein the thickness of the handle tapers in the direction of the part thereof which is connected to the applicator head.

10. The brush as claimed in claim 1, wherein the transverse dimension of the handle decreases in the direction of the part thereof which is connected to the applicator head, the ratio between the minimum and the maximum of the transverse dimension of the handle being between 0.3 and 0.8.

11. The brush as claimed in claim 1, wherein the longitudinal axis along which the handle extends is rectilinear over a whole length of the handle.

12. The brush as claimed in claim 1, wherein the longitudinal axis of each bristle is oriented substantially perpendicular to the longitudinal axis of the applicator head, at a base thereof, where it connects to the applicator head.

13. An assembly for applying a product, comprising:

an applicator brush as defined in claim 1, and a container containing the product to be applied, selected from a care product for the eyebrows, or a make-up product to be applied to the eyebrows, being in the form of a powder, a gel or a wax.

14. A process for making up the eyebrows, using an assembly as claimed in claim 13, wherein the product is taken up from the container by means of the applicator brush, and wherein the product is applied to the eyebrows by means of the applicator brush.

* * * * *